US011661316B2

(12) United States Patent
Makinen et al.

(10) Patent No.: US 11,661,316 B2
(45) Date of Patent: May 30, 2023

(54) METHOD AND AN ARRANGEMENT FOR ELEVATOR GUIDE RAIL INSTALLATION

(71) Applicant: Kone Corporation, Helsinki (FI)

(72) Inventors: Harri Makinen, Helsinki (FI); Mikael Haag, Helsinki (FI)

(73) Assignee: Kone Corporation, Helsinki (FI)

( * ) Notice: Subject to any disclaimer, the term of this patent is extended or adjusted under 35 U.S.C. 154(b) by 105 days.

(21) Appl. No.: 16/902,467

(22) Filed: Jun. 16, 2020

(65) Prior Publication Data

US 2021/0016996 A1 Jan. 21, 2021

(30) Foreign Application Priority Data

Jul. 16, 2019 (EP) ..... 19186453

(51) Int. Cl.
*B66B 19/00* (2006.01)
*B66B 7/02* (2006.01)
*B66B 7/04* (2006.01)

(52) U.S. Cl.
CPC ..... *B66B 19/002* (2013.01); *B66B 7/023* (2013.01); *B66B 7/024* (2013.01); *B66B 7/026* (2013.01); *B66B 7/046* (2013.01)

(58) Field of Classification Search
CPC ..... B66B 7/021; B66B 7/023; B66B 7/024; B66B 7/026; B66B 19/002
See application file for complete search history.

(56) References Cited

U.S. PATENT DOCUMENTS

| | | | | |
|---|---|---|---|---|
| 9,592,997 | B2 * | 3/2017 | Mertala | B66B 19/002 |
| 2015/0314993 | A1 * | 11/2015 | Bolme | B66B 19/002 52/741.1 |
| 2016/0311657 | A1 | 10/2016 | Kilpelainen | |
| 2016/0311659 | A1 | 10/2016 | Mertala | |
| 2018/0170712 | A1 * | 6/2018 | Fauconnet | B66B 7/026 |
| 2018/0208438 | A1 | 7/2018 | Cambruzzi et al. | |
| 2019/0177120 | A1 | 6/2019 | Studer et al. | |

FOREIGN PATENT DOCUMENTS

| | | | |
|---|---|---|---|
| JP | H05178561 | A | 7/1993 |
| JP | H05338955 | A | 12/1993 |
| WO | WO-2018/060261 | A1 | 4/2018 |

OTHER PUBLICATIONS

Extended European Search Report for European Application No. 19186453.7 dated Mar. 20, 2020.

* cited by examiner

*Primary Examiner* — Minh Truong
(74) *Attorney, Agent, or Firm* — Harness, Dickey & Pierce, P.L.C.

(57) ABSTRACT

The method comprises measuring the shaft with measuring equipment from a movable transport platform, whereby the form of the shaft and the position of the fastening points for the guide rails is determined based on the information received in the measurement phase, attaching fastening brackets to the guide rail elements and adjusting the fastening brackets based on the measurement results before the installation of the guide rails takes place so that the guide rail elements provided with the fastening brackets can be lifted in the shaft and attached to the fastening points without further adjustment of the fastening brackets.

14 Claims, 15 Drawing Sheets

METHOD AND AN ARRANGEMENT FOR ELEVATOR GUIDE RAIL INSTALLATION

RELATED APPLICATIONS

Figure 1:
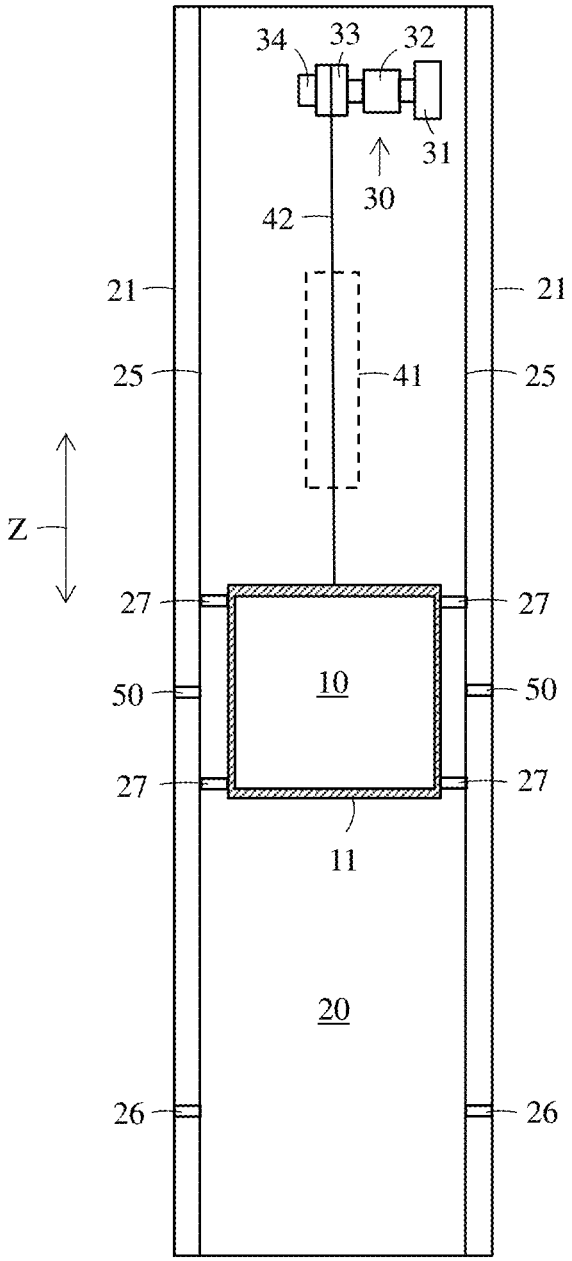

This application claims priority to European Patent Application No. 19186453.7 filed on Jul. 16, 2019, the entire contents of which are incorporated herein by reference.

FIELD

The invention relates to a method and an arrangement for elevator guide rail installation.

BACKGROUND

An elevator may comprise a car, a shaft, hoisting machinery, ropes, and a counterweight. A separate or an integrated car frame may surround the car.

The hoisting machinery may be positioned in the shaft. The hoisting machinery may comprise a drive, an electric motor, a traction sheave, and a machinery brake. The hoisting machinery may move the car upwards and downwards in the shaft. The machinery brake may stop the rotation of the traction sheave and thereby the movement of the elevator car.

The car frame may be connected by the ropes via the traction sheave to the counterweight. The car frame may further be supported with gliding means at guide rails extending in the vertical direction in the shaft. The guide rails may be attached with fastening brackets to the side wall structures in the shaft. The gliding means keep the car in position in the horizontal plane, when the car moves upwards and downwards in the shaft. The counterweight may be supported in a corresponding way on guide rails that are attached to the wall structure of the shaft.

The car may transport people and/or goods between the landings in the building. The wall structure of the shaft may be formed of solid walls or of an open beam structure or of any combination of these.

The guide rails may be formed of guide rail elements of a certain length. The guide rail elements may be connected in the installation phase end-on-end one after the other in the elevator shaft. The guide rail elements may be attached to each other with connection plates extending between the end portions of two consecutive guide rail elements. The connection plates may be attached to the consecutive guide rail elements. The ends of the guide rails may comprise some kind of form locking means in order to position the guide rails correctly in relation to each other. The guide rails may be attached to the walls of the elevator shaft with support means at support points along the height of the guide rails.

The installation of guide rails according to prior art methods involves considerable complexity including transporting, lifting and positioning guide rails in an elevator installation. The time required for a guide rail installation according to prior art methods is also considerable. These problems become even more profound in modern high rise buildings.

SUMMARY

An object of the invention is an improved method and arrangement for elevator guide rail installation.

The method for elevator guide rail installation according to the invention is defined in claim 1.

The arrangement for elevator guide rail installation according to the invention is defined in claim 12.

The shaft is first measured with measuring equipment in order to determine the form of the shaft and the position of the fastening points for the guide rails along the height of the shaft based on the measurement results.

Adjustable fastening brackets are then attached to the guide rails and the fastening brackets are adjusted based on the information received in the measurement phase. This may be done before the installation of the guide rails takes place in the shaft.

The invention means that the guide rail elements provided with the fastening brackets may in the installation process of the guide rails be lifted in the shaft and attached to the fastening points in a wall of the shaft without further adjustment of the fastening brackets.

The invention simplifies and shortens the time needed for the installation of the guide rails compared to a prior art solution in which the fastening brackets are attached to the guide rail elements in the shaft and adjusted after that during the installation of the guide rails.

The guide rail elements may in an embodiment be lifted upwards in the shaft with a hoist connected to a transport device comprising a hook device and a lever device. The hook device may be attached to an upper end of the guide rail element and the lower end of the guide rail element may be glidingly supported with the lever device on the row of already installed guide rail elements. The guide rail element may thus be lifted in a controlled manner i.e. the guide rail cannot swing during the lifting.

The lowering of the transport apparatus in order to fetch a new guide rail element may also be done in a controlled manner. The lever device may also when moving downwards be glidingly supported on the row of already installed guide rail elements.

The hook device may in an embodiment move upwards and downwards in the shaft without being connected to the row of already installed guide rail elements. Only the lever device may in this embodiment move glidingly on the row of already installed guide rail elements during an upwards and downwards movement in the shaft.

The hook device may on the other hand also be glidingly supported on the row of already installed guide rail elements. The hook device may in this embodiment move glidingly on the row of already installed guide rail elements during a downwards movement in the shaft. The hook device may not in this embodiment be connected to the row of already installed guide rail elements during an upwards movement in the shaft.

The hook device may in all embodiments be fixedly attached to the upper end of the guide rail element during the lifting of the guide rail element.

A transport platform movable with a hoist upwards and downwards in the shaft may be used during the measurement of the shaft before the installation of the guide rails and/or during a manual installation of a first lowermost section of guide rail elements and/or during the installation of the guide rails in order to attach the guide rail elements to a wall in the shaft. The attachment of the guide rail elements to the wall in the shaft may be done manually by a technician or automatically by a robot from the transport platform.

Each end of the guide rail elements may further in an embodiment be provided with jointing clamps. The jointing clamps may form a plug-in joint between themselves and thereby between two consecutive guide rail elements when the jointing clamps and thereby two consecutive guide rail elements are connected to each other.

DRAWINGS

Figure 2:
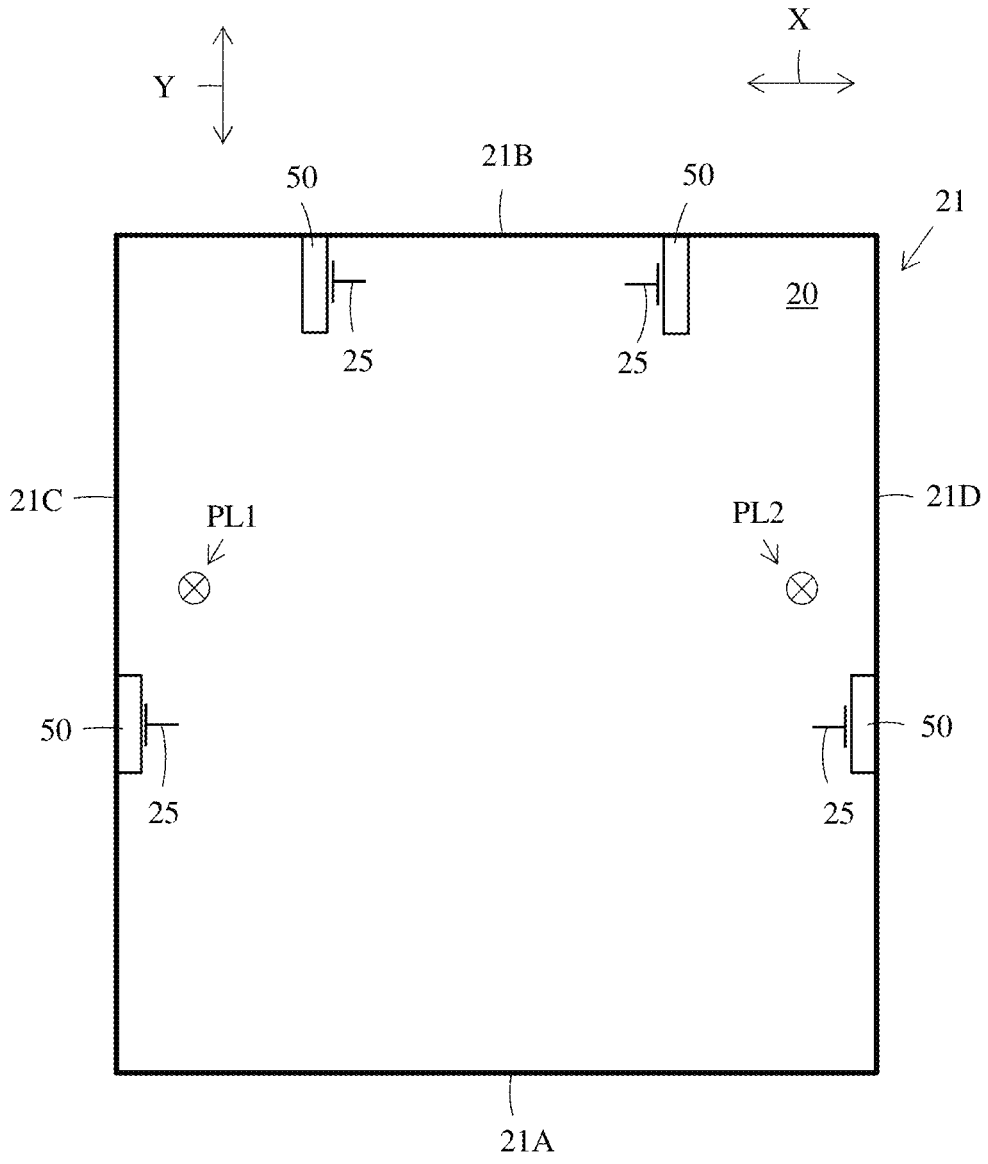
Figure 3:
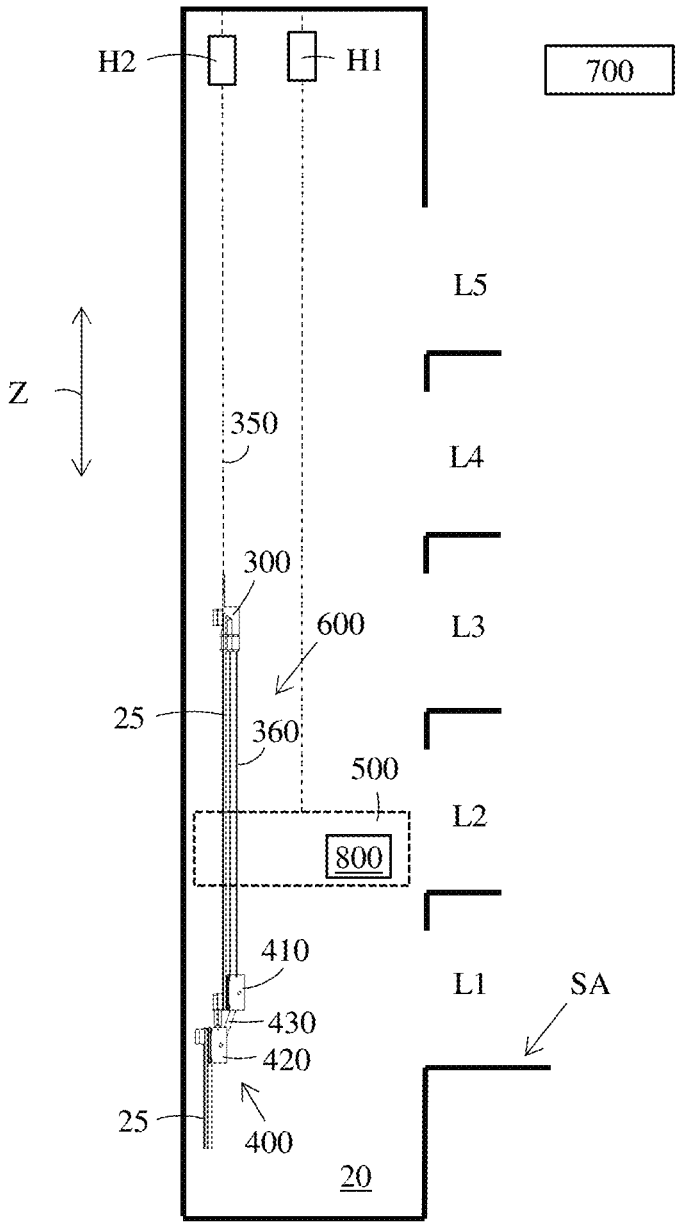
Figure 4:
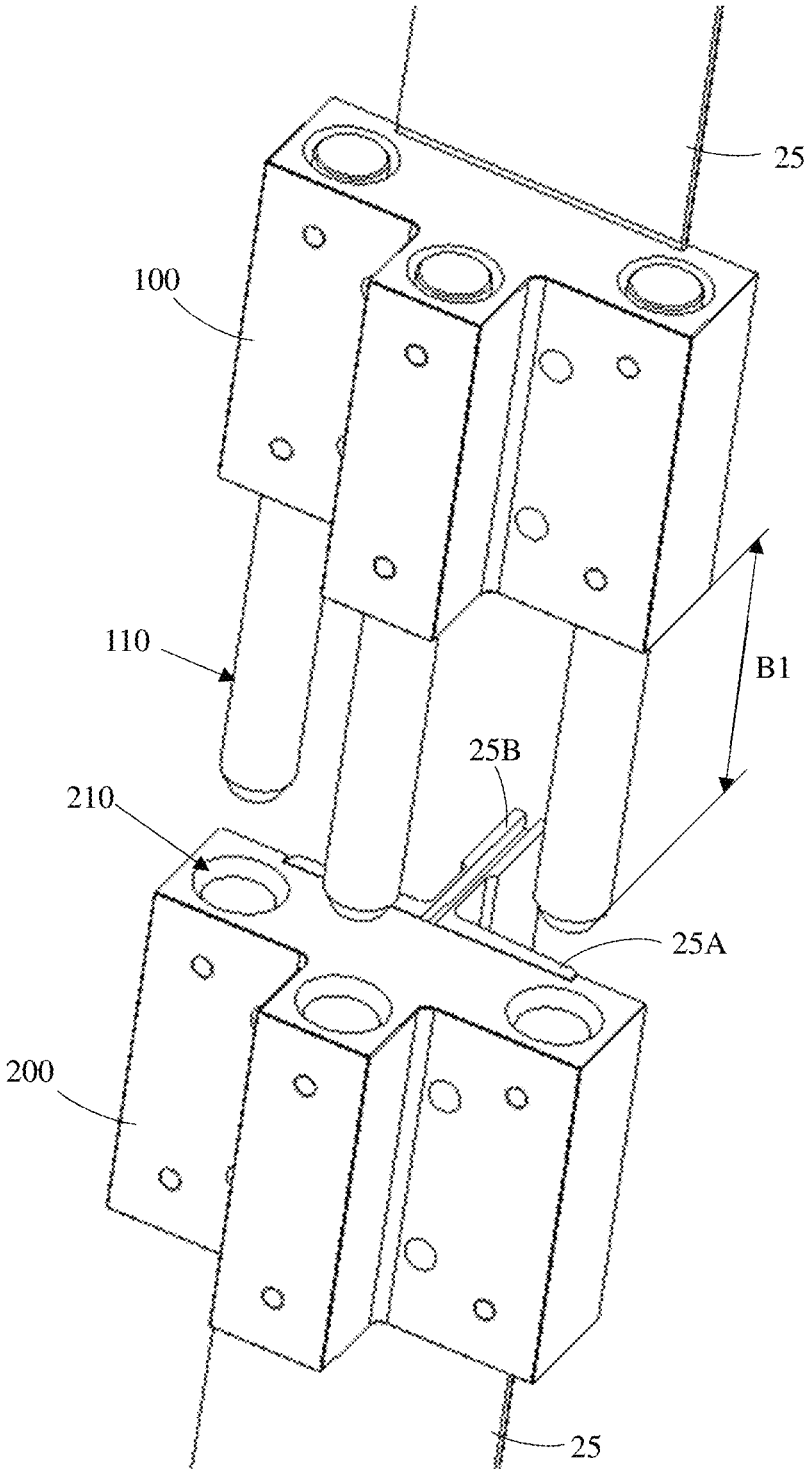
Figure 5:
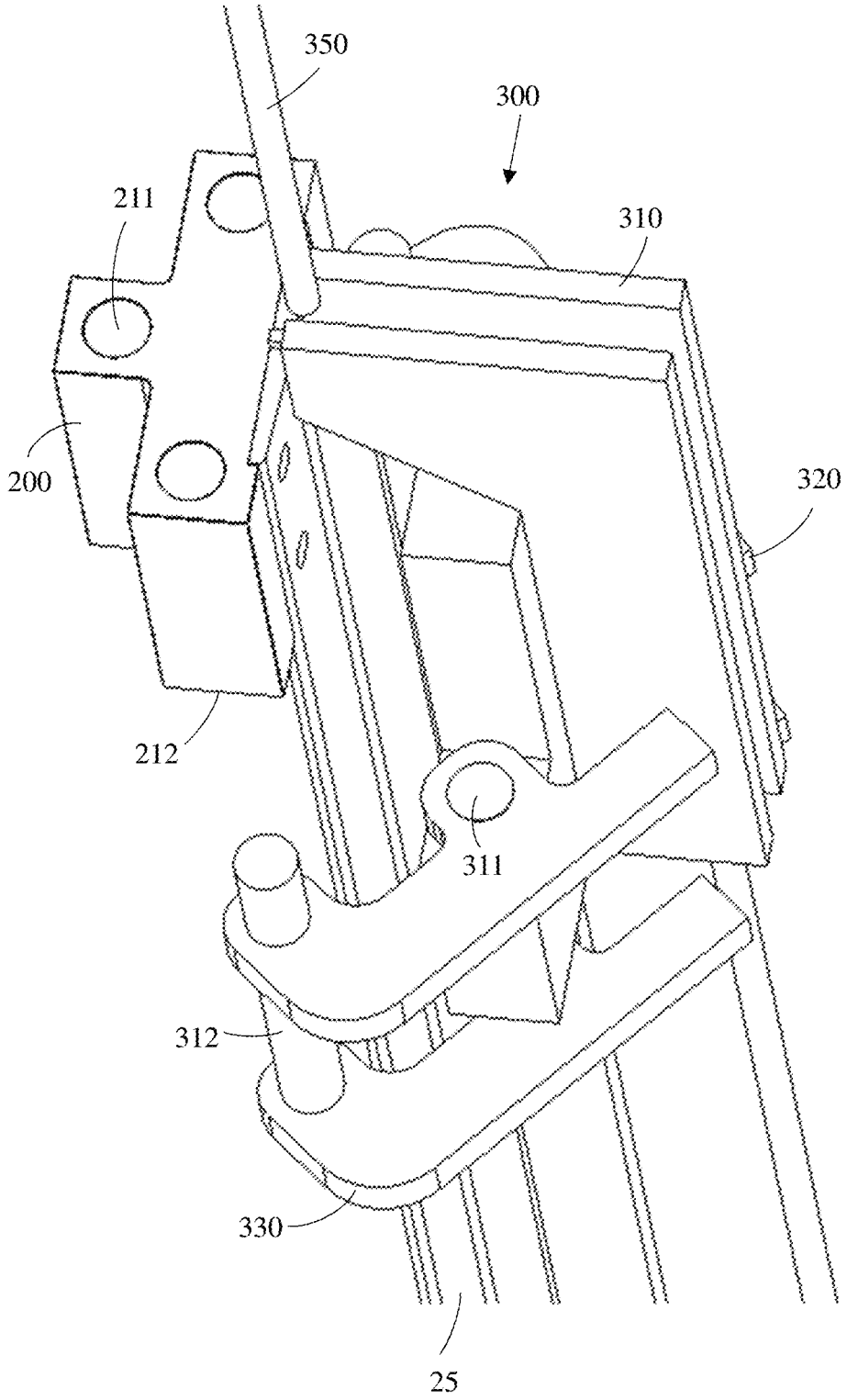
Figure 6:
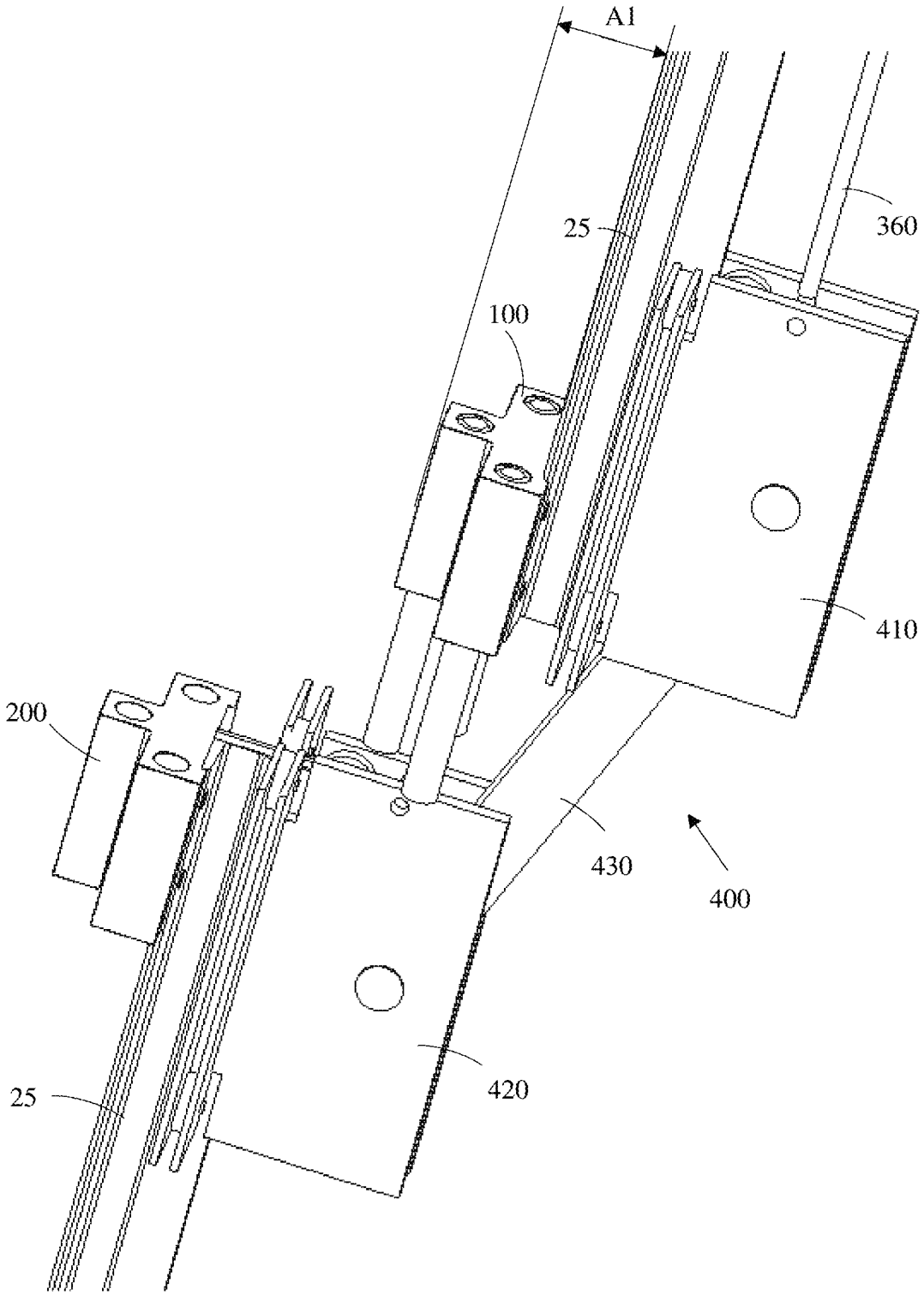
Figure 7:
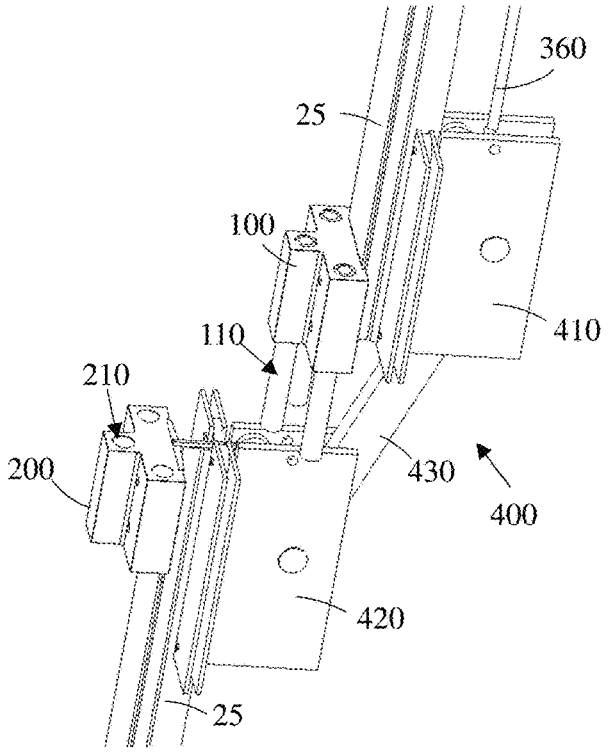
Figure 8:
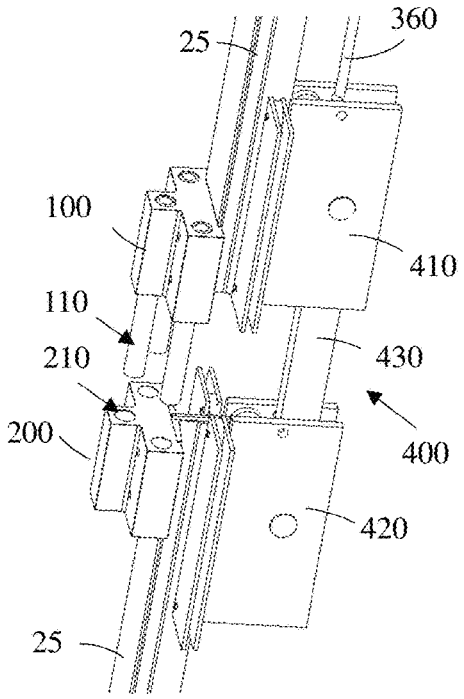
Figure 9:
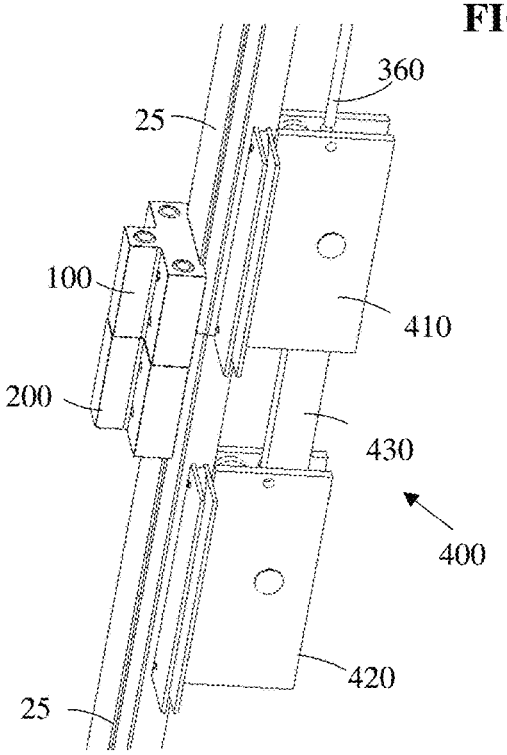
Figure 10:
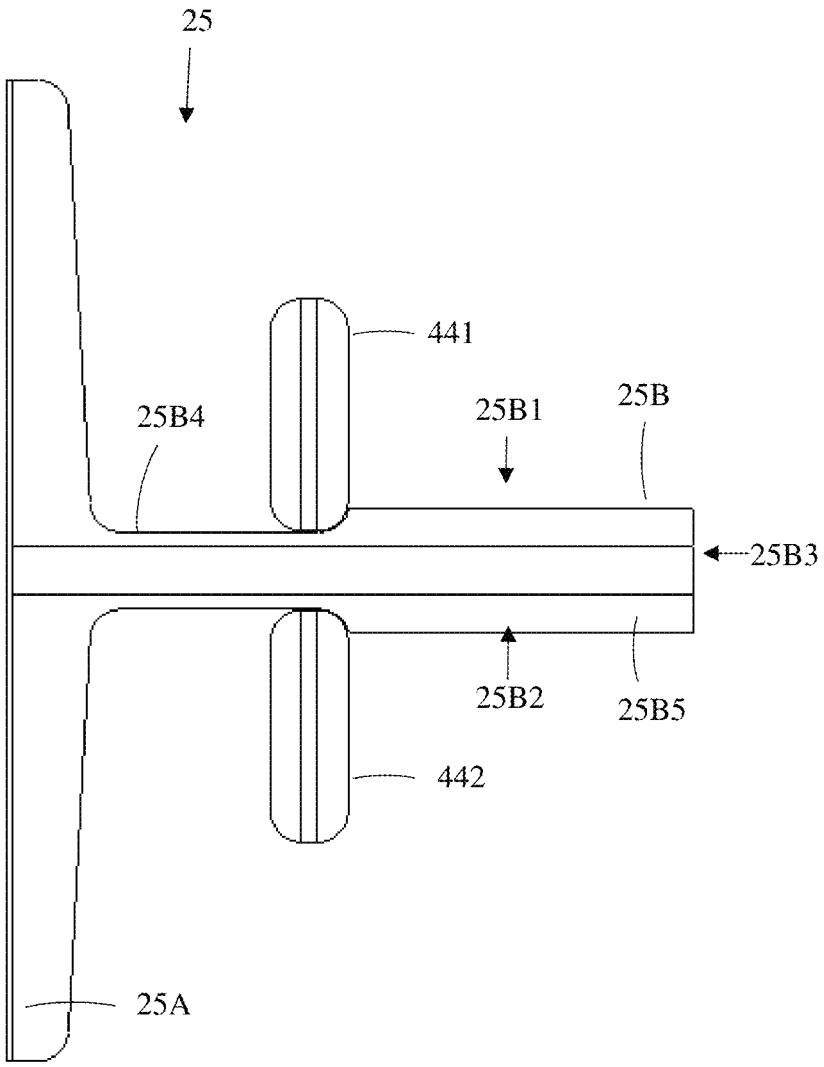
Figure 11:
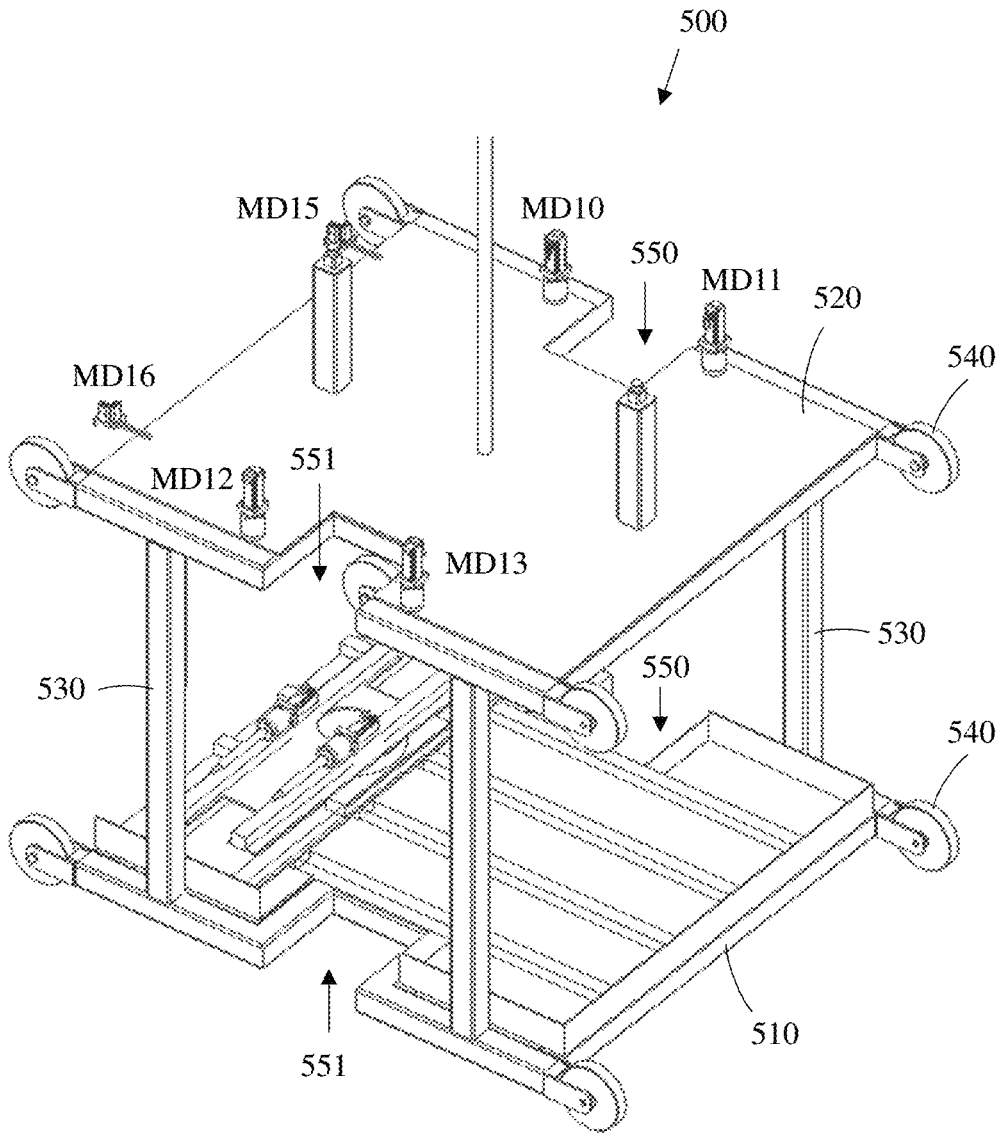
Figure 12:
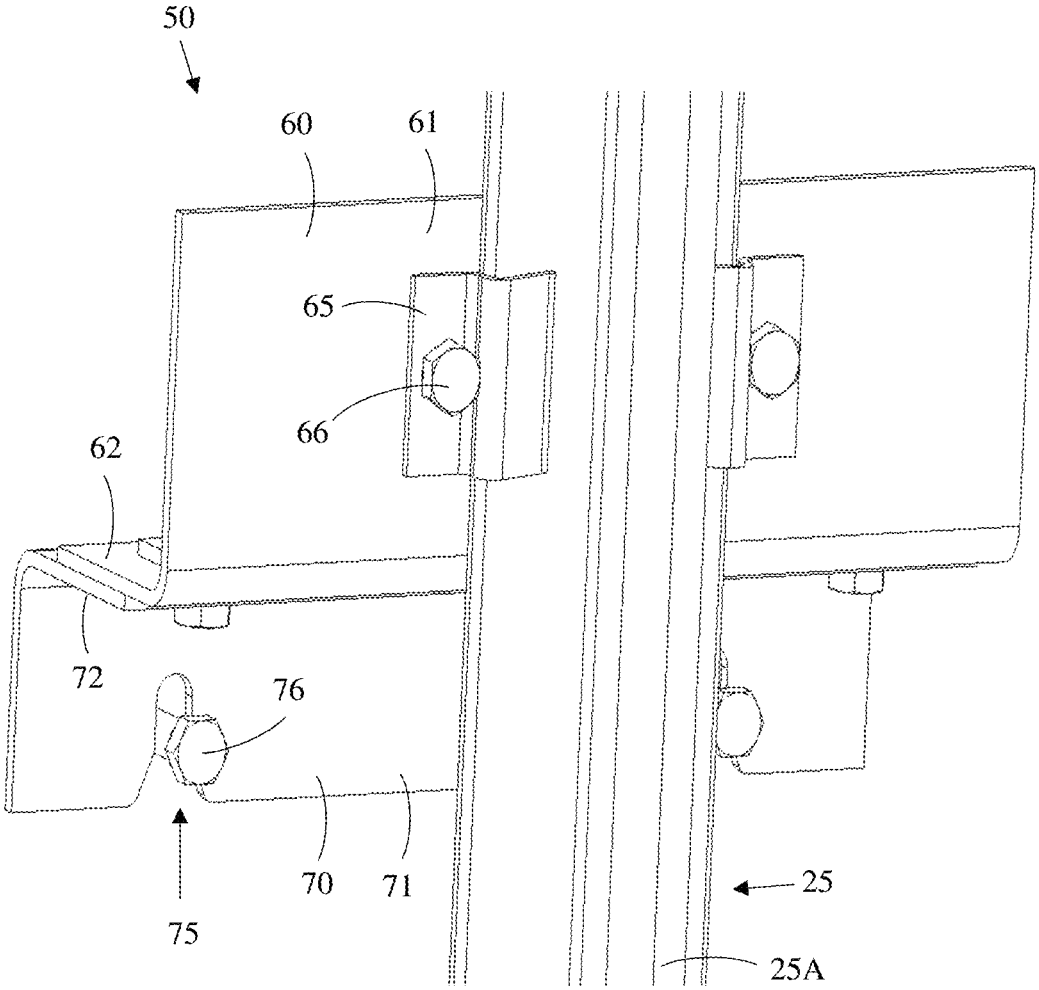
Figure 13:
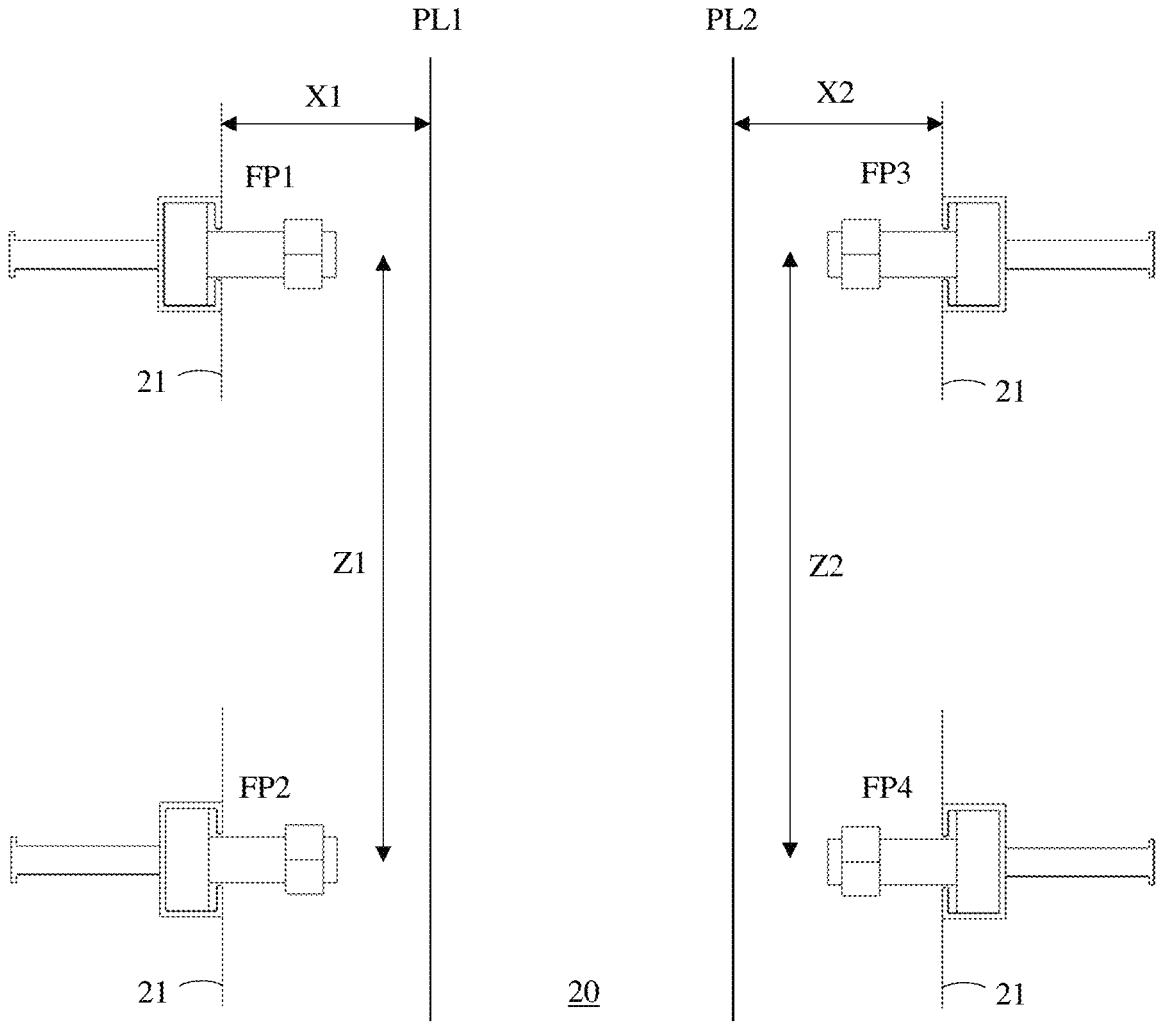
Figure 14:
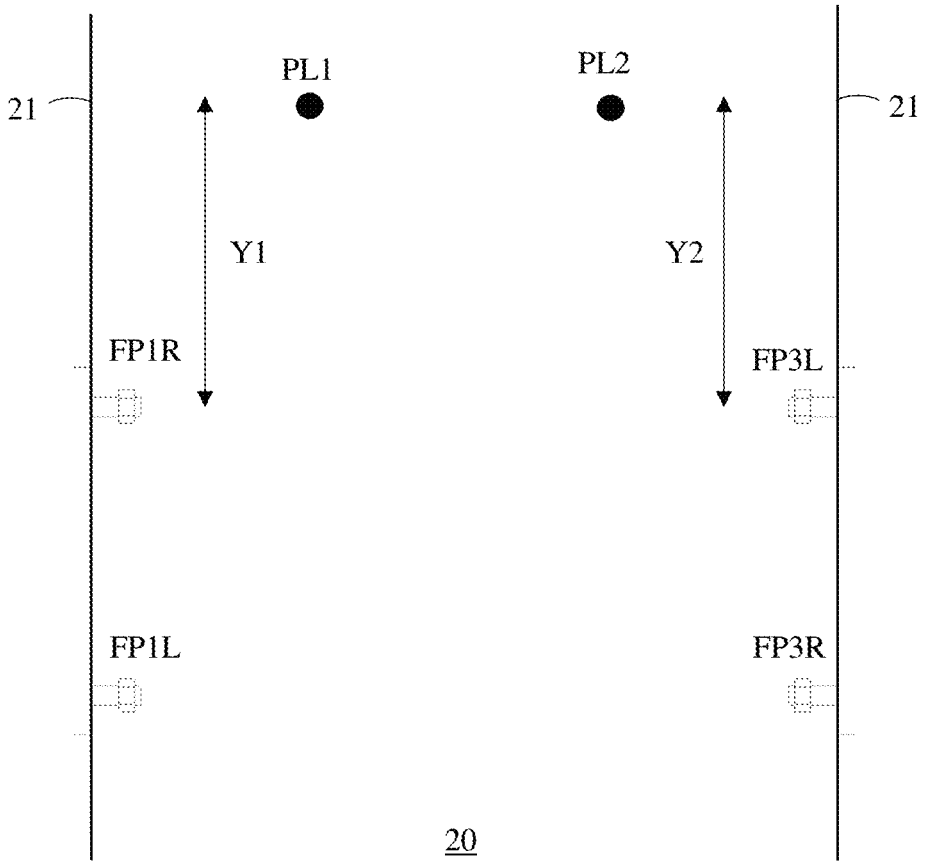
Figure 15:
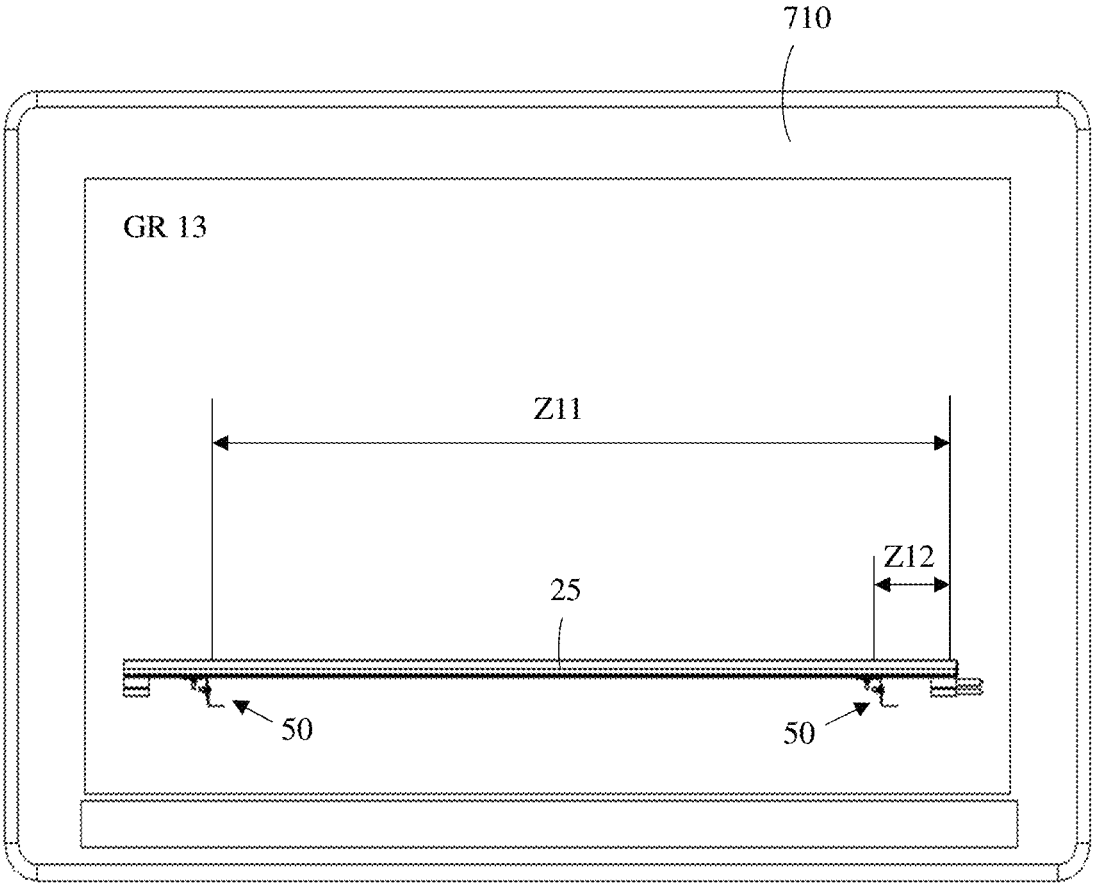
Figure 16:
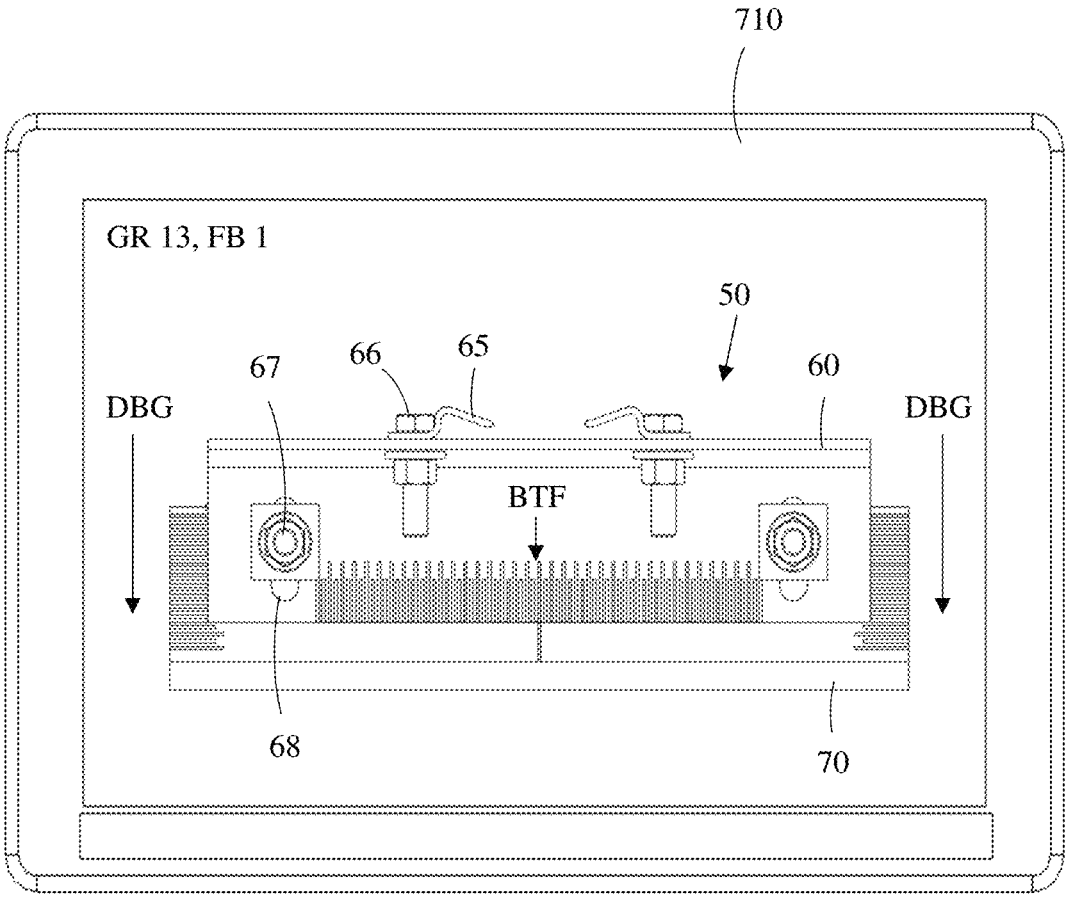
Figure 17:
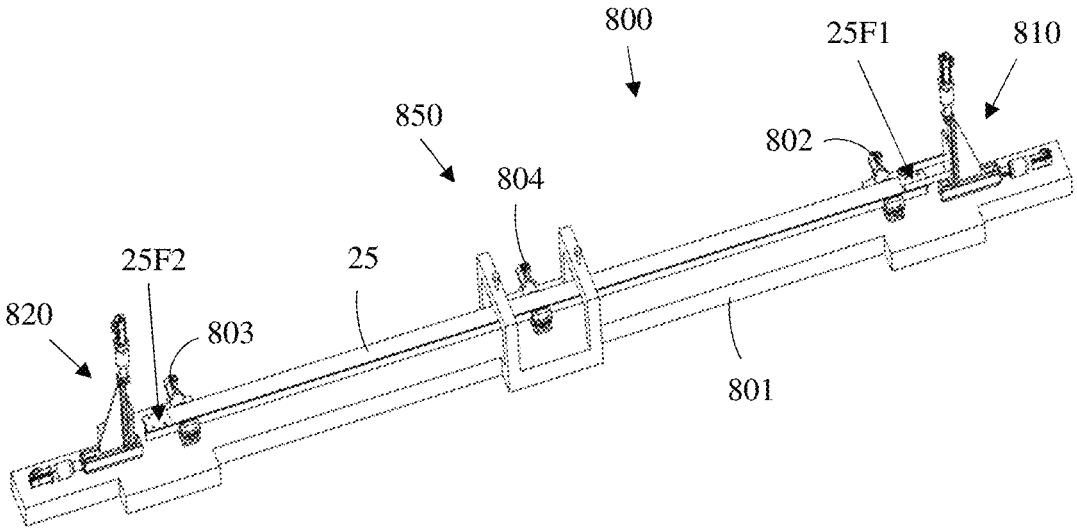
Figure 18:
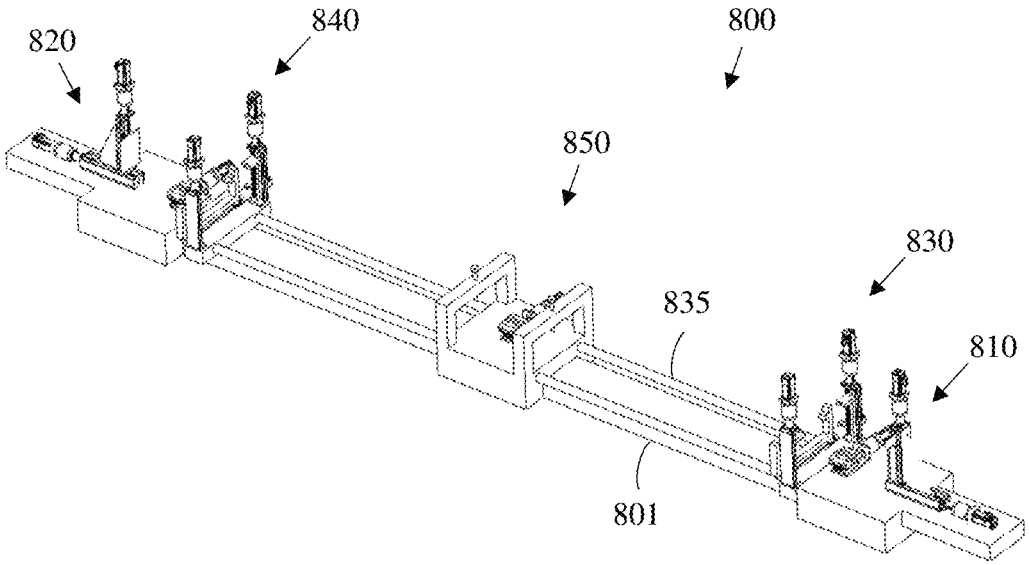

The invention will in the following be described in greater detail by means of preferred embodiments with reference to the attached drawings, in which FIG. 1 shows a side view of an elevator, FIG. 2 shows a horizontal cross section of the elevator, FIG. 3 shows an arrangement for installing guide rails, FIG. 4 shows an arrangement for joining guide rails, FIG. 5 shows a hook device of a transport apparatus, FIG. 6 shows a lever device of a transport apparatus, FIGS. 7-9 show the lever device of the transport apparatus in different positions, FIG. 10 shows a cross-section of a guide rail, FIG. 11 shows a transport platform, FIG. 12 shows a fastening bracket, FIG. 13 shows a vertical cross-section of the shaft exemplifying the measurement of the shaft, FIG. 14 shows a horizontal cross-section of the shaft exemplifying the measurement of the shaft, FIG. 15 sows the attachment of fastening brackets on the guide rail, FIG. 16 shows the adjustment of the fastening brackets, FIG. 17 shows a first embodiment of a guide rail pre-setting bench, FIG. 18 shows a second embodiment of a guide rail pre-setting bench.

DETAILED DESCRIPTION

FIG. 1 shows a side view and FIG. 2 shows a horizontal cross section of the elevator.

The elevator may comprise a car 10, an elevator shaft 20, hoisting machinery 30, ropes 42, and a counterweight 41. A separate or an integrated car frame 11 may surround the car 10.

The hoisting machinery 30 may be positioned in the shaft 20. The hoisting machinery may comprise a drive 31, an electric motor 32, a traction sheave 33, and a machinery brake 34. The hoisting machinery 30 may move the car 10 in a vertical direction Z upwards and downwards in the vertically extending elevator shaft 20. The machinery brake 34 may stop the rotation of the traction sheave 33 and thereby the movement of the elevator car 10.

The car frame 11 may be connected by the ropes 42 via the traction sheave 33 to the counterweight 41. The car frame 11 may further be supported with gliding means 27 at guide rails 25 extending in the vertical direction in the shaft 20. The gliding means 27 may comprise rolls rolling on the guide rails 25 or gliding shoes gliding on the guide rails 25 when the car 10 is moving upwards and downwards in the elevator shaft 20. The guide rails 25 may be attached with fastening brackets 50 to the side wall structures 21 in the elevator shaft 20. The gliding means 27 keep the car 10 in position in the horizontal plane when the car 10 moves upwards and downwards in the elevator shaft 20. The counterweight 41 may be supported in a corresponding way on guide rails that are attached to the wall structure 21 of the shaft 20.

The wall structure 21 of the shaft 20 may be formed of solid walls 21 or of open beam structure or of any combination of these. One or more of the walls may thus be solid and one or more of the walls may be formed of an open beam structure. The shaft 20 may be comprise a front wall 21A, a back wall 21B and two opposite side walls 21C, 21D. There may be two guide rails 25 for the car 10. The two car guide rails 25 may be positioned on opposite side walls 21C, 21D. There may further be two guide rails 25 for the counterweight 41. The two counterweight guide rails 25 may be positioned on the back wall 21B.

The guide rails 25 may extend vertically along the height of the elevator shaft 20. The guide rails 25 may thus be formed of guide rail elements of a certain length e.g. 5 m. The guide rail elements 25 may be installed end-on-end one after the other. The guide rail elements 25 may be attached to each other with connection plates extending between the end portions of two consecutive guide rail elements 25. The connection plates may be attached to the consecutive guide rail elements 25. The ends of the guide rails 25 may comprise some kind of form locking means in order to position the guide rails 25 correctly in relation to each other. The guide rails 25 may be attached to the walls 21 of the elevator shaft 20 with support means at support points along the height of the guide rails 25.

The car 10 may transport people and/or goods between the landings in the building.

FIG. 2 shows plumb lines PL1, PL2 in the shaft 20, which may be produced by plumbing of the shaft 20 before the installation of the elevator. The plumb lines PL1, PL2 may be formed with traditional wires or with light sources e.g. lasers having the beams directed upwards along the plumb lines PL1, PL2. One plumb line and a gyroscope or two plumb lines are normally needed for a global measurement reference in the shaft 20.

FIG. 1 shows a first direction S1, which is a vertical direction in the elevator shaft 20. FIG. 2 shows a second direction S2, which is the direction between the guide rails (DBG) and a third direction S3, which is the direction from the back wall to the front wall (BTF) in the shaft 20. The second direction S2 is perpendicular to the third direction S3. The second direction S2 and the third direction S3 are perpendicular to the first direction S1.

FIG. 3 shows an arrangement for installing guide rails.

The figure shows five landings L1-L5 in the shaft 20, but there could naturally be any number of landings in the shaft 20.

A first hoist H1 may be arranged in the shaft 20 in order to move a transport platform 500 upwards and downwards in the shaft 20. The first hoist H1 may be suspended from the ceiling of the shaft 20.

A second hoist H2 may be arranged in the shaft 20 in order to move a transport apparatus 600 upwards and downwards in the shaft 20. The second hoist H2 may be suspended from a ceiling of the shaft 20.

The transport platform 500 may be supported with rolls on opposite solid walls 21 in the shaft 20. There is no need to connect the transport platform 500 to the guide rails 25 in any way. The transport platform 500 may be used to transport one or more technicians and/or one or more robots and/or tools in the shaft 20. A horizontal cross-section of the transport platform 500 may be provided with passages for the guide rails 25. The transport platform 500 may be used for measuring the shaft 20 before the elevator installation and/or for installing the guide rails to the wall 21 of the shaft 20 and/or for aligning the guide rails 25 after the elevator installation.

A storage area SA may be arranged on the first landing L1. The storage area SA could naturally be arranged at any position below the working level of the guide rail installation. The storage area SA could first be positioned on the first landing L1 and then later relocated to a higher landing as the installation advances. The guide rail elements 25 may be stored on the storage area SA and lifted with the transport apparatus 600. The guide rail elements 25 may be loaded manually on the transport apparatus 600.

The shaft 20 may first be measured with measuring equipment 800 positioned on a transport platform 500. The results of the measurement may then be used to determine the form of the shaft 20 and the position of the fastening points for the guide rails 25 along the height of the shaft 20.

Adjustable fastening brackets 50 may then be attached to the guide rails 25 based on the information received in the measurement stage. The fastening brackets 50 may further be adjusted based on the information received in the measurement stage.

The measurement of the shaft 20 and the attachment and adjustment of the fastening brackets 50 may be done before the installation of the guide rail 25 takes place in the shaft 20. The fastening and adjustment of the fastening brackets 50 to the guide rail elements 25 may take place at the elevator installation site. The guide rail elements 25 provided with the fastening brackets 50 should be marked so that they can be identified later when the installation of the guide rail elements 25 starts. A guide rail element 25 provided with the fastening brackets 50 belongs to a specific row of guide rail elements 25 and to a specific height position in the specific row of guide rail elements 25.

A first lowermost section of guide rails 25 may be installed into the shaft 20 manually. The transport platform 500 may be used in the manual installation of the first section of guide rails 25 to the shaft 20.

The figure shows a situation in which a first guide rail element 25 in a second section of guide rails 25 is lifted upwards in the shaft 20 with the transport apparatus 600 connected to the second hoist H2. The transport apparatus 600 may comprise a hook device 300 connected to the second hoist H2 and a lever device 400 connected to the hook device 300. The hook device 300 may be connected with a first wire 350 to the second hoist H2. The lever device 400 may be connected with a second wire 360 to the hook device 300. The lever device 400 may comprise an upper lever part 410 and a lower lever part 420. The upper lever part 410 and the lower lever part 420 may be connected to each other with a lever arm 430.

An upper end of the guide rail element 25 may be attached to the hook device 300 and thereby to the second hoist H2.

A lower end of the guide rail element 25 to be lifted may be attached to the upper lever part 410. The lower lever part 420 may be glidingly supported on the row of already installed guide rail elements 25.

The guide rail element 25 may thus be lifted with the second hoist H2 and the transport apparatus 600 along the row of already installed guide rail elements 25. The upper end of the guide rail element 25 may be firmly attached to the hook device 300. The lifting force is thus transferred from the second hoist H2 to the hook device 300 and further to the guide rail element 25. The lower end of the guide rail element 25 may be attached to the upper lever part 410. The lower lever part 420 may glide on the row of already installed guide rail elements 25. The lower lever part 420 may be glidingly connected to the row of already installed guide rail elements 25 during the upward movement.

The guide rail element 25 may be lifted along the row of already installed guide rail elements 25 to a height in which the lower lever part 420 reaches the upper end of the row of already installed guide rail elements 25.

The guide rail element 25 may then be disconnected from the lever device 400. The lower end of the guide rail element 25 may thereafter be connected to the upper end of the row of already installed guide rail elements 25. The guide rail element 25 may finally be attached to the wall 21 of the shaft 20.

The transport device 600 may thereafter be moved downwards along the row of already installed guide rail elements 25 with the second hoist H2. The lever device 400 may glide on the row of already installed guide rail elements 25 when moving downwards. The lever device 400 may be glidingly supported of the row of already installed guide rail elements 25. The hook device 300 may in an embodiment be glidingly supported on the row of already installed guide rail elements 25 during the downwards movement of the hook device 300 in the shaft 20.

A control unit 700 may be used to control the measurements, to store the information received from the measurements and to perform calculations based on the information received from the measurements. The control unit 700 may further send the information received from the measurements to a display device. The attachment and alignment of the fastening brackets on the guide rail elements 25 may be done based on the displayed information.

FIG. 4 shows an arrangement for joining guide rails.

The figure shows one possibility of joining two consecutive guide rail elements 25 together with jointing clamps 100, 200 provided on the guide rail element 25. The figure shows a lower end portion of an upper guide rail element 25 and an upper end portion of a lower guide rail element 25. The two guide rail elements 25 are to be joined together.

A cross-section of the guide rail element 25 may have the form of a letter T having a flat bottom portion 25A and a flat support portion 25B protruding outwardly from the middle of the bottom portion 25A. The guide rail element 25 may be attached with fastening brackets to a wall 21 in the shaft 20 from the bottom portion 25A of the guide rail element 25. The support portion 25B of the guide rail element 25 may form two opposite side support surfaces and one end support surface for the support shoes of the car 10 or the counterweight 41. The support shoes may be provided with gliding surfaces or rollers acting on the support surfaces of the support portion 25B of the guide rail element 25.

Each guide rail element 25 may be provided with a first jointing clamp 100 attached to a first end of the guide rail element 25 and a second jointing clamp 200 attached to a second opposite end of the guide rail element 25. The first end of the guide rail element 25 may be the lower end of the guide rail element 25 and the second end of the guide rail element 25 may be the upper end of the guide rail element 25. The figure shows the first jointing clamp 100 on the lower end of the upper guide rail element 25 and the second jointing clamp 200 on the upper end of the lower guide rail element 25.

Each guide rail element 25 may be provided with transverse through holes in the bottom portion 25B of the guide rail element 25 at each end of the guide rail element 25. The first jointing clamp 100 and the second jointing clamp 200 may on the other hand be provided with corresponding threaded holes. Bolts may pass through the holes in the bottom portion in the guide rail element 25 into the threaded holes in the first and the second jointing clamp 100, 200 in order to attach the first and the second jointing clamp 100, 200 to the respective end of the guide rail element 25. The jointing clamps 100, 200 are thus positioned on an opposite surface of the bottom portion of the guide rail 25 in relation to the support portion of the guide rail 25.

A first outer end of the first jointing clamp 100 may be substantially flush with the lower end of the guide rail element 25. The first jointing clamp 100 may comprise male joint elements 110 extending in a longitudinal direction outwards from the first end of the first jointing clamp 100. The longitudinal direction may coincide with the longitudinal direction of the guide rail element 25. The male joint elements 110 may be adapted to pass into corresponding female joint elements 210 in the second jointing clamp 200. The male joint elements 110 may have an equal axial length B1. The axial length B1 of the male joint elements 110 could on the other hand be staggered. The benefit of using male joint elements 110 with a staggered axial length B1 would be to be able to guide the first jointing clamp 100 and the second jointing clamp 200 into a correct position in relation to each other in one direction at a time. The first jointing clamp 100 and the second jointing clamp 200 may be pre-set into correct positions on the guide rail elements 25 before the installation in the shaft 20. The pre-setting is beneficial when using male joint elements 110 with an equal axial length B1.

The male joint elements 110 may be formed of pins. A transverse cross-section of the pins may be circular. The female joint elements 210 may be formed of holes. A transverse cross-section of holes corresponds to the transverse cross-section of the pins.

The number of male joint elements 110 as well as the number of female joint elements 210 is three in this embodiment, but there could be any number of male joint elements 110 in the first jointing clamp 100 and a corresponding number of female joint elements 210 in the second jointing clamp 200. There may thus be at least one male joint element 110 in the first jointing clamp 100 and at least one female joint element 210 in the second jointing clamp 200. The three mail joint elements 110 and the three female joint elements 210 may be positioned in the corners of a triangle.

The number of male joint elements 110 in the first jointing clamp 100 and the number of female joint elements 220 in the second jointing clamp 200 may be equal.

The first jointing clamp 100 and the second jointing clamp 200 may form a plug-in joint between two consecutive guide rail elements 25.

The first jointing clamp 100 may be produced so that through holes are bored in the longitudinal direction of the first jointing clamp 100. The male joint elements 110 are then inserted into the holes and attached in the holes with a pressure joint. There will thus remain blind bored holes extending into the first jointing clamp 100 from the second inner end of the first jointing clamp 100.

A first outer end of the second jointing clamp 200 may be substantially flush with the upper end of the guide rail element 25. The second jointing clamp 200 may comprise holes 210 passing in a longitudinal direction into the second jointing clamp 200 from the first end of the second jointing clamp 200. The longitudinal direction may coincide with the longitudinal direction of the guide rail element 25. The holes 210 may be through holes passing through the second jointing clamp 200.

The two consecutive guide rail elements 25 will be in a correct position in relation to each other when the pins 110 of the first jointing clamp 100 have been pushed fully into the holes 210 of the second jointing clamp 200. The first end surface of the first jointing clamp 100 and the first end surface of the second jointing clamp 200 are then positioned against each other. The opposite surfaces of the two consecutive guide rail elements 25 are also positioned against each other in this position.

The weight of the one or more upper guide rail element 25 will keep the first jointing clamp 100 and the second jointing clamp 200 together. The guide rail elements 25 will naturally also be attached to the wall 21 of the shaft 20 with fastening brackets, whereby movement of the guide rail elements 25 in any direction is eliminated. There is thus probably no need for a separate locking between the first jointing clamp 100 and the second jointing clamp 200. It is naturally possible to provide a separate locking between the first jointing clamp 100 and the second jointing clamp 200 if needed. The locking could be realized as a snap locking between the first jointing clamp 100 and the second jointing clamp 200.

Another possibility would be to provide e.g. the outer end of the middlemost pin 110 with a threading. The middlemost pin 110 could be made long enough so that the outer end of the pin would protrude out from the opposite end of the second jointing clamp 200, when the first jointing clamp 100 and the second jointing clamp 200 are joined together. A nut could then be screwed on the threading in the middlemost pin 110 in order to lock the two jointing clamps 100, 200 together.

The opposite end surfaces of two consecutive guide rail elements 25 may further be provided with a form locking. One end surface could be provided with a groove and the opposite end surface could be provided with a protrusion seating into the groove.

The first jointing clamp 100 and the second jointing clamp 200 may be made of cast iron or of aluminium.

The pins 110 in the first jointing clamp 100 may be made of cold drawn steel bars. The pins 110 could on the other hand also be made of plastic.

The outer ends of the pins 110 in the first jointing clamp 100 may be chamfered in order to facilitate the alignment of the pins 110 into the holes 210 in the second jointing clamp 200.

FIG. 5 shows a hook device of a transport apparatus.

The hook device 300 may comprise a body portion 310 and two locking members 320, 330 pivotably attached to the body portion 310. Each locking member 320, 330 may comprise two parallel rocker arms at a distance from each other. The rocker arms may be pivotably supported via a first shaft 311 on the body portion 310. A second shaft 312 may pass between the outer ends of the rocker arms. The second shaft 312 may protrude upwards from the upper rocker arm. The rocker arms may be spring loaded. The locking members 320, 330 are shown in an open position in the figure. The locking members 320, 330 turn into the locking position when there is tension in the first wire 350 passing to the first hoist H1. The outer ends of the locking members 320, 330 provided with the second shaft 312 will thus turn towards each other so that the outer ends of the second shaft 312 protrude into a respective hole 211, 212 in the second jointing clamp 200 attached to the end of the guide rail element 25.

The locking members 320, 330 will turn into the open position shown in the figure when the tension in the first wire 350 passing to the first hoist H1 is released. The hook 300 will fall downwards so that the outer ends of the second shaft 312 of the locking members 320, 330 falls out from the respective holes 211, 212 in the second jointing clamp 200. The spring means will then push the locking members 320, 330 into the open position shown in the figure.

The hook device 300 may, when the locking members 320, 330 are in the open position, glide along the guide rail 25 downwards when the first hoist H1 unwinds the first wire 350 passing from the first hoist H1 to the hook 300. The weight of the hook device 300 will ensure that the hook device 300 glides downwards along the guide rail 25 when the first support wire 350 is unwounded from the first hoist H1.

FIG. 6 shows a lever device of a transport apparatus.

The lever device 400 comprises an upper lever part 410 and a lower lever part 420. The lower lever part 420 glides on the already installed guide rail 25. The upper lever part 410 receives a lower end of the guide rail element 25 to be lifted. The upper lever part 410 is connected to the lower lever part 420 via a lever arm 430.

FIG. 6 shows the lever device 400 during the lifting of the guide rail element 25. The lower lever part 420 of the lever device 400 glides on the guide rail 25 that have already been installed to the wall 21 of the shaft 20. The lower end of the guide rail element 25 to be lifted is supported on the upper lever part 410 of the lever device 400. The lever arm 430 may be pivotably attached to the upper lever part 410 and to the lower lever part 420 of the lever device 400. The lever arm 430 is shown in an inclined position forming a first operational position. The lever arm 430 may be locked in this first operational position so that the guide rail element 25 to be lifted is kept at a distance from the guide rail 25 that has already been installed to the wall 21 of the shaft 20. The upper lever part 410 is at a distance A1 from the row of already installed guide rail elements 25. This distance A1 leaves room for the guide rail element 25 provided with the first jointing clamp 100 to pass on the outer side of the row of already installed guide rail elements 25 when the guide rail element 25 is lifted.

FIGS. 7-9 show the lever device of the transport apparatus in different positions.

The second hoist H2 may be connected with a first wire 350 to the transport apparatus 600 i.e. to the hook device 300 of the transport apparatus 600 positioned at the upper end of the transport apparatus 600. The lever device 400 of the transport apparatus 600 may be connected with a second wire 360 to the hook device 300. (see FIG. 3).

FIG. 7 shows the lever device 400 in a position in which the lever device 400 has just reached the upper end of the row of already installed guide rail elements 25.

FIG. 8 shows the lever device 400 in a position in which the lower part 420 of the lever device has stopped at the upper end of the row of already installed guide rail elements 25. The locking of the lever arm 430 has been released and the lever arm 430 has been stretched out into a straight position in relation to the longitudinal direction of the row of already installed guide rail elements 25.

FIG. 9 shows the lever device 400 in a position in which the lever device 400 has moved downwards so that the pins 110 in the first jointing clamp 100 have been pushed into the respective holes 210 in the second jointing clamp 200.

FIG. 10 shows a cross-section of a guide rail.

A cross-section of the guide rail element 25 may have the form of a letter T having a flat bottom portion 25A and a flat support portion 25B protruding outwardly from the middle of the bottom portion 25A. The guide rail element 25 may be attached with fastening brackets to a wall 21 in the shaft 20 from the bottom portion 25A of the guide rail element 25. The support portion 25B of the guide rail element 25 may form two opposite side support surfaces 25B1, 25B2 and one end support surface 25B3 for the support shoes of the car 10 or the counterweight 41. The support shoes may be provided with gliding surfaces or rollers acting on the support surfaces 25B1, 25B2, 25B3 of the support portion 25B of the guide rail element 25.

The hook device 300 and the lever device 400 i.e. the upper lever part 410 and the lower lever part 420 may be provided with rollers 441, 442 or gliding shoes rolling or gliding on the inner thinner portion 25B4 of the support portion 25B of the guide rail 25. The rollers 441, 442 or gliding shoes may be positioned in the transition between the lower thinner portion 25B4 and the outer thicker portion 25B5 of the support portion 25B of the guide rail 25. The rollers 441, 442 in the hook device 300 will keep the hook device 300 secured to the guide rail 25 during the downwards movement of the hook device 300 on the row of already installed guide rail elements 25. The rollers 441, 442 in the lower lever part 420 will keep the lever device 400 secured to the guide rail 25 during the upwards and downwards movement of the lever device 400 on the row of already installed guide rail elements 25. The rollers 441, 442 in the upper lever part 410 will keep the lower end of the guide rail element 25 secured to the upper lever part 410 during the upwards movement of the transport device 600 on the guide rail 25.

The rollers 441, 442 may be movably supported in the hook device 300 and in the lever device 400. The rollers 441, 442 may be moved between a first position in which the rollers 441, 442 are in contact with the guide rail 25 as seen in the figure and a second position in which the rollers 441, 442 are out of contact from the guide rail 25. The hook device 300 and the lever device 400 may be disconnected from the guide rail 25 when the rollers 441, 442 are in the second position.

FIG. 11 shows a transport platform.

The transport platform 500 may comprise a bottom plane 510 and a roof plane 520 positioned at a vertical distance above the bottom plane 510. The bottom plane 510 may form a work surface for one or more technicians and/or for one or more robots. Vertical support bars 530 may extend between the bottom plane 510 and the roof plane 520. Two support rollers 540 are provided at opposite ends in each plane 510, 520 in the transport platform 500. The support rollers 540 support the transport platform 500 on opposite walls 21 in the shaft 20. The support rollers 540 keep the transport platform 500 substantially in a horizontal plane when the transport platform 500 is moved upwards and downwards in the shaft 20. The transport platform 500 may further be provided with locking means for locking the transport platform to the walls 21 in the shaft 20. The locking means could be realized with hydraulic cylinders acting against two opposite walls 21 in the shaft 20.

By-pass passages 550, 551 for guide rail elements 25 to be lifted during the installation of the guide rails 25 may further be formed in the transport platform 500. The by-pass passages 550, 551 may be formed of recesses protruding inwards from a perimeter of the transport platform 500. The by-pass passages 550, 551 also provide space for the plumb lines PL1, PL2 to by-pass the transport platform 500.

The transport platform 500 may be provided with measuring equipment for measuring the form of the shaft 20 and/or the position of the fastening points for the guide rails 50 in the shaft 20 and/or the position of the transport platform 500 in the shaft 20. The transport platform 500 may be provided with measuring devices MD10, MD11, MD12, MD13 for measuring the position of the transport platform 500 in relation to the shaft 20. The measuring devices MD10, MD11, MD12, MD13 may determine the position of the transport platform 500 in the shaft 20 based on the plumb lines PL1, PL2 once the transport platform 500 is locked in the shaft 20. The measuring devices MD10, MD11, MD12, MD13 can be based on a sensor measuring without contact the position of the plumb lines PL1, PL2 being formed of wires. Another possibility is to use light sources e.g. lasers on the bottom of the elevator shaft producing upwards directed light beams that can be measured with the measuring devices MD10, MD11, MD12, MD13 on the transport platform 500. The measuring devices MD10, MD11, MD12, MD13 could be light sensitive sensors or digital imaging devices measuring the hit points of the light beams produced by the light sources. The light source could be a robotic total station, whereby the measuring devices MD10, MD11, MD12, MD13 would be reflectors reflecting the light beams back to the robotic total station. The robotic total station would then measure the position of the measuring devices MD10, MD11, MD12, MD13.

The transport platform 500 may further be provided with distance measurement devises MD15, MD16 for measuring the vertical position i.e. the height position of the transport platform 500 in the shaft 20. The distance measurement may be based on a laser measurement.

FIG. 12 shows a fastening bracket.

The fastening bracket 50 may be formed of two separate bracket parts 60, 70 that are movably attached to each other. The first bracket part 60 may have the shape of a letter L with a vertical portion 61 and a horizontal portion 62. The second bracket part 70 may also have the shape of a letter L with a vertical portion 71 and a horizontal portion 72. The first bracket part 60 may be attached to the guide rail 25 and a second bracket part 70 may be attached to a wall 21 in the shaft 20. The horizontal portions 62, 72 of the two bracket parts 60, 70 may be adjustably attached to each other.

The vertical portion 61 of the first bracket part 60 may be attached with a clamp 65 and a bolt 66 to the bottom portion 25A of the guide rail 25.

The vertical portion 71 of the second bracket part 70 may be attached to the wall 21 in the shaft 20 with anchor bolts 76. The vertical portion 71 in the second bracket part 70 may comprise oblong openings 75 being open at the lower end of the vertical portion 71 in the second bracket part 70. Holes for the anchor bolts 76 may be drilled into the walls 21 of the shaft 20 at predetermined positions already before the installation of the guide rails 25 is started. Anchor bolts 76 may be screwed into the holes. The anchor bolts 76 may be screwed only partly into the threading so that the head of the anchor bolts 76 is at a distance from the fastening surface.

The horizontal portion 62 of the first bracket part 60 and the horizontal portion 72 second bracket part 70 may be attached each other with bolts passing through oblong openings in the horizontal portion 62 of the first bracket part 60 and in the horizontal portion 72 of the second bracket part 70. The oblong openings may be dimensioned so that it is possible to fine adjust the position of the first bracket part 60 in relation to the second bracket part 70 in order to be able to align the guide rails 25.

The fastening brackets 50 may be installed into predetermined positions on the guide rail elements 25 to be installed already before the guide rail elements 25 to be installed are lifted in the shaft 20.

The fastening brackets 50 that have been attached to the guide rail elements 25 already before the guide rails elements 25 are lifted will then become positioned just above the bolts 76 when the lever arm 430 turns to the second operational position. Lowering of the guide rail element 25 to be installed will also lower the fastening brackets 50 attached to the guide rail element 25 so that the oblong openings 75 glide on the bolts 76.

Tightening of the bolts 76 will attach the second bracket part 70 of the fastening bracket 50 to the wall 21 in the shaft 20. The bolts 76 may be tightened from the transport platform 500 manually by a technician or with a robot.

Another possibility would be to drill the anchor holes during the installation of the guide rails 25. This could be done manually or automatically from the transport platform 500.

The guide rails 25 may be aligned after they have been installed to the respective walls 21 in the shaft 20. The alignment of the guide rails 25 may be done by in any known manner.

FIG. 13 shows a vertical cross-section of the shaft exemplifying the measurement of the shaft.

The figure shows on the left hand side in connection with a first side wall 21 of the shaft 20 an upper fastening point FP1 and a lower fastening point FP2. The two fastening points FP1, FP2 are positioned at a vertical distance Z1 apart from each other. A guide rail element 25 will be fasted with fastening brackets 50 to the fastening points FP1, FP2.

The figure shows on the right hand side in connection with a second opposite side wall 21 of the shaft 20 an upper fastening point FP3 and a lower fastening point FP4. The two fastening points FP3, FP4 are positioned at a vertical distance Z2 apart from each other. A guide rail element 25 will be fasted with fastening brackets 50 to the fastening points FP3, FP4.

The figure shows further the vertical plumb lines PL1, PL2 in the shaft 20. The distance X1, X2 from a plumb line PL1, PL2 to a closest fastening point FP1, FP3 may thus be measured. These distances X1, X2 are thus measured in the direction between guide rails (DBG).

FIG. 14 shows a horizontal cross-section of the shaft exemplifying the measurement of the shaft.

The figure shows on the left hand side in connection with a first side wall 21 of the shaft 20 two fastening points FP1R, FP1L positioned at a distance from each other in a horizontal plane in the shaft 20. These two fastening points FP1R, FP1L are intended for one fastening bracket 50. The fastening bracket 50 is attached from two support points FP1R, FP1L to the first side wall 21 of the shaft 20 as can be seen in FIG. 12.

The figure shows on the left hand side in connection with a second opposite side wall 21 of the shaft 20 two fastening points FP3R, FP3L positioned at a predetermined distance from each other in a horizontal plane in the shaft 20. These two fastening points FP3R, FP3L are intended for one fastening bracket 50.

The distance Y1 from the first plumb line PL1 to the closest left hand fastening point FP1R may be measured. The distance from the second plumb line PL2 to the closest right hand fastening point FP3L may also be measured in a corresponding way. The distance between the left hand fastening points FP1L, FP1R is known and the distance between the right hand fastening points FP3L, FP3R is also known. The distances are thus measured in the direction between the back wall and the front wall of the shaft (BTF).

These measurements may be done from the transport platform 500 before the installation of the elevator takes place.

FIG. 15 shows the attachment of the fastening brackets on the guide rail.

The figure shows a display device 710 which may be connected to the control unit 700. Attachment of the fastening brackets 50 into a correct position on the guide rail element 25 may be done based on the information received from the display device 710. The display device 710 may show the distance Z12 to the lower fastening bracket 50 and the distance Z11 to the upper fastening bracket 50 measured from the lower end of the specific guide rail element 25. A technician may thus first retrieve this distance information Z11, Z12 for a specific guide rail element 25, e.g. GR 13, from the display device 710 after which the technician may attach the fastening brackets 50 into a correct position on the specific guide rail element 25.

FIG. 16 shows the adjustment of the fastening brackets.

The figure shows a display device 710 which may be connected to the control unit 700. Adjustment of the fastening brackets 50 into a correct position on the guide rail element 25 may be done based on the information received from the display device 710. The display device 710 may show the BTF adjustment point on a line scale formed on the fastening bracket 50. There may be a single reference line on the second bracket part 70 and several adjacent lines on the first bracket part 60. The display device 710 may further show the DBG adjustment points on both sides of the fastening bracket 50 on a line scale formed on the fastening bracket 50. There may be several adjacent lines formed on the second bracket part 70. The lower edge of the first bracket part 60 may form a single reference line. A technician may thus first retrieve this BFT and DGB adjustment information for a specific guide rail element 25, e.g. GR 13, and a specific fastening bracket, e.g. FB 1, from the display device 710 after which the technician may adjust the specific fastening bracket FB 1 into a correct position on the specific guide rail element 25.

The oblong openings 68 in the horizontal portions 62, 72 of the two bracket parts 60, 70 and the bolts 67 attaching the two bracket parts 60, 70 to each other are also shown in the figure. The clamps 65 and the bolts 66 for attaching the first bracket part 60 to the guide rail 25 are also shown in the figure.

FIG. 17 shows a first embodiment of a guide rail pre-setting bench.

The guide rail pre-setting bench 800 may comprise a frame 801, a jointing clamp setting unit 810, 820 at each end portion of the frame 801, and a guide rail straightening unit 850 in a middle portion of the frame 801.

The guide rail element 25 may be positioned in the frame 801 and attached to the frame 801 from both ends and from the middle with fastening means 802, 803, 804 provided on the frame 801. The straightness of the guide rail element 25 may thereafter be measured. The guide rail element 25 may be forced to be straight with the fastening means 804 on the middle portion of the frame 801. The dimensions and the flatness of the guide rail element 25 interface surface 25F1, 25F2 for the jointing clamps 100, 200 may be checked to a common reference. A correct amount and/or thickness of shims may then be installed into correct positions on the interface surface 25F1, 25F2 based on the previous measurement of the guide rail interface surfaces 25F1, 25F2 for the jointing clamps 100, 200. The jointing clamps 100, 200 may thereafter be attached to the interface surfaces 25F1, 25F2 of the guide rail element 25, whereby the shims secure the correct position of the jointing clamps 100, 200. The interface surface 25F1, 25F2 may be a standard interface surface provided on the guide rail elements 25 for attaching the connection plates between the ends of two consecutive guide rail elements 25.

The fastening of the jointing clamps 100, 200 to the guide rail element 25 may be done manually in the bench. This could, however, also be done partly or fully automatically in the bench.

FIG. 18 shows a second embodiment of a guide rail pre-setting bench.

The guide rail pre-setting bench 800 may comprise a frame 801, a jointing clamp setting unit 810, 820 at each end portion of the frame 801, a fastening bracket setting unit 830, 840 at each end portion of the frame 801, and a guide rail straightening unit 850 in a middle portion of the frame 801.

The fastening bracket setting units 830, 840 may be movable in a longitudinal direction of the frame 801 along guide bars 835 provided on the frame 801.

The fastening brackets 50 may be attached to the guide rail element 25 with the fastening bracket setting units 830, 840. The fastening bracket setting units 830, 840 may be used in order to position the fastening brackets 50 into correct position on the guide rail element 50. The fastening brackets 50 may thereafter be adjusted as described earlier.

The fastening of the fastening brackets 50 to the guide rail element 25 may be done manually in the bench. This could, however, also be done partly or fully automatically in the bench.

The adjustment of the fastening brackets 50 may also be done manually in the bench. This could, however, also be done partly or fully automatically in the bench.

The guide rail pre-setting bench 800 may be provided with several servo motors in connection with the jointing clamp setting units 810, 820, the fastening bracket setting units 830, 840, and the guide rail straightening unit 850 in order to be able to perform an automatic installation and/or adjustment of the jointing clamps 100, 200 and/or the fastening brackets 50 on the guide rail element 25. Also a mixture of automatic and manual steps could be used in this connection.

The use of jointing clamps 100, 200 at the ends of the guide rail elements 25 is a further advantageous option in the invention. The jointing clamps 100, 200 are not, however, necessary in the invention. The guide rail elements 25 could be provided only with the fastening brackets 50 and a connection plate attached to the upper interface surface 25F1, 25F2 of the guide rail element 25 to be lifted in the shaft 20. The hook device 300 could be attached to the upper end of the guide rail element 25 into the step between the guide rail element 25 and the connection plate. The consecutive guide rail elements 25 would then be connected to each other with the connection plates instead of the jointing clamps 100, 200.

The measuring equipment 800 positioned on the transport platform 500 for measuring the shaft 20 may be formed of any measurement equipment suitable for the purpose of measuring the form of the shaft 20 and the position of the fastening points in the shaft 20. The measuring equipment 800 could be formed of a single measuring device or of several measuring devices. The measuring equipment 800 could be formed of multiple low cost distance measurement sensors e.g. radar and/or ultra sound and/or laser distance sensors and/or inductive sensors arranged to scan the shaft 20 in order to achieve the measurement results that are needed in this invention.

The measuring equipment 800 could naturally also be formed of a laser scanner as well as of a 3D vision system. These systems are, however, based on detecting measurements from 3D point clouds, whereby a lot of memory and computing capacity is needed. The computing is also time consuming. These systems might therefore not be optimal as measuring equipment 800 in this invention.

The figures show an embodiment in which only one second hoist H2 with a transport device 600 is used. The suspension point for the second hoist H2 would have to be changed during the installation. Each row of guide rail elements 25 to be installed would need a suspension point of their own for the second hoist H2. Several second hoists H2 could naturally be suspended from the ceiling of the shaft 20. Each second hoist H2 would thus be provided with a transport device 600 of its own. This would mean that several rows of guide rails 25 could be installed simultaneously into the shaft 20.

The invention is not limited to the fastening bracket 50 shown in the figures. Any kind of adjustable fastening brackets 50 may be used in the invention.

The shaft 20 in the figures is intended for only one car 10, but the invention could naturally be used in shafts intended for several cars 10. Such elevator shafts 10 could be divided into sub-shafts for each car 10 with steel bars. Horizontal steel bars could be provided at predetermined intervals along the height of the shaft 20. A part of the guide rails 25 would then be attached to the steel bars in the shaft 20. Another part of the guide rails 25 would be attached to solid walls 21 in the shaft 20.

The invention may be used in low rise or in high rise buildings. The benefits of the invention are naturally greater in high rise buildings. High rise buildings may have a hoisting height over 75 meters, preferably over 100 meters, more preferably over 150 meters, most preferably over 250 meters.

The use of the invention is not limited to the elevator disclosed in the figures. The invention can be used in any type of elevator e.g. an elevator comprising a machine room or lacking a machine room, an elevator comprising a counterweight or lacking a counterweight. The counterweight could be positioned on either side wall or on both side walls or on the back wall of the elevator shaft. The drive, the motor, the traction sheave, and the machine brake could be positioned in a machine room or somewhere in the elevator shaft. The car guide rails could be positioned on opposite side walls of the shaft or on a back wall of the shaft in a so called ruck-sack elevator.

It will be obvious to a person skilled in the art that, as the technology advances, the inventive concept can be implemented in various ways. The invention and its embodiments are not limited to the examples described above but may vary within the scope of the claims.

The invention claimed is:

1. A method for elevator guide rail installation, the method comprising measuring a shaft with measuring equipment positioned on a transport platform arranged to be movable with a first hoist upwards and downwards in the shaft, whereby a form of the shaft and a position of fastening points for a set of guide rails along a height of the shaft is determined based on measurement results, attaching adjustable fastening brackets to the guide rails and adjusting the fastening brackets to set a position of the fastening bracket along the guide rail and set the guide rail to shaft side wall structure spacing based on information received from the measuring before installation of the guide rails takes place in the shaft so that guide rail elements provided with the fastening brackets can be lifted in the shaft and attached to the fastening points in a wall of the shaft without further adjustment of the fastening brackets.

2. The method according to claim 1, further comprising using fastening brackets comprising two bracket parts adjustable to each other, a first bracket part being attachable to the guide rail element and a second bracket part being attachable to a wall in the shaft, whereby the first bracket part is attached into the correct height position of the guide rail element after which the two bracket parts are adjusted to each other based on the information received from the measuring.

3. The method according to claim 1, further comprising installing manually a lowermost section of guide rail elements to respective walls in the shaft, arranging a transport apparatus movable upwards and downwards with a second hoist into the shaft in order to lift guide rail elements in the shaft, the transport apparatus comprising a hook device connected to the second hoist and a lever device connected to the hook device, connecting a guide rail element to the transport apparatus so that an upper end of the guide rail element is connected to the hook device and a lower end of the guide rail element is supported on the lever device, moving the transport apparatus and thereby also the guide rail element upwards with the second hoist, the lever device gliding on a row of already installed guide rail elements, connecting the guide rail element to an upper end of the row of already installed guide rail elements, attaching the fastening brackets of the guide rail element to a wall of the shaft from the transport platform, moving the transport apparatus downwards with the second hoist in order to fetch a new guide rail element, the lever device gliding on the row of already installed guide rail elements.

4. The method according to claim 1, further comprising attaching a first jointing clamp to a lower end of the guide rail element and a second jointing clamp to an upper end of the guide rail before the installation of the guide rails takes place in the shaft so that the guide rail elements provided with the jointing clamps and the fastening brackets can be lifted in the shaft in order to be installed in the shaft, the first jointing clamp and the second jointing clamp forming a plug-in joint between the first jointing clamp and the second jointing clamp and thereby between two consecutive guide rail elements when the first jointing clamp and the second jointing clamp are connected to each other.

5. The method according to claim 4, wherein the first jointing clamp comprises at least one male joint element and the second jointing clamp comprises at least one female joint element or vice a versa, the male joint element and the female joint element forming the plug-in joint between the first jointing clamp and the second jointing clamp and thereby between two consecutive guide rail elements when the first jointing clamp and the second jointing clamp are connected to each other.

6. The method according to claim 5, wherein the male joint element is formed of a pin and the female joint element is formed of a hole receiving the pin.

7. The method according to claim 4, further comprising installing manually a lowermost section of guide rail elements to respective walls in the shaft, arranging a transport apparatus movable upwards and downwards with a second hoist into the shaft in order to lift guide rail elements in the shaft, the transport apparatus comprising a hook device connected to the second hoist and a lever device connected to the hook device, connecting a guide rail element to the transport apparatus so that the second jointing clamp at the upper end of the guide rail is connected to the hook device and the lower end of the guide rail element is supported on the lever device, moving the transport apparatus and thereby also the guide rail element upwards with the second hoist, the lever device gliding on a row of already installed guide rail elements, connecting the guide rail element to an upper end of the row of already installed guide rail elements with the plug-in joint provided by the first jointing clamp and the second jointing clamp, attaching the brackets of the guide rail element to a wall of the shaft from the transport platform, moving the transport apparatus downwards with the second hoist in order to fetch a new guide rail element, the hook device and the lever device gliding on the row of already installed guide rail elements.

8. The method according to claim 4, wherein a lever device comprises an upper lever part, a lower lever part and a lever arm having a first end pivotably attached to the upper lever part and a second opposite end pivotably attached to the lower lever part, the lower lever part being glidingly supported on the row of already installed guide rail elements and the lower end of the guide rail element being supported on the upper lever part.

9. The method according to claim 8, wherein the lever arm has a first operational position in which the lever arm is inclined making the upper lever part and the lower lever part staggered in relation to each other so that the upper lever part is at a horizontal distance from the row of already installed guide rail elements leaving space for the lower end of the guide rail element with the first jointing clamp, and a second operational position in which the lever arm is straight so that the upper lever part and the lower lever part are in line with each other.

10. The method according to claim 9, wherein the lever arm is in the first operational position when the guide rail element is moved upwards along the row of already installed guide rail elements.

11. The method according to claim 9, wherein the lever arm changes to the second operational position when the lower lever part reaches the upper end of the row of already installed guide rail elements making the first jointing clamp and the second jointing clamp in line with each other, whereby lowering of the guide rail element results in that the plug-in joint between the first and the second jointing clamp closes joining the guide rail element to the uppermost guide rail element in the row of already installed guide rail elements.

12. An arrangement for elevator guide rail installation, said arrangement comprising:

a transport platform moving upwards and downwards in a shaft with a first hoist, whereby the shaft is measured with measuring equipment positioned on the transport platform, the information received in the measurement being used to determine a form of the shaft and a position of fastening points for guide rails along a height of the shaft, adjustable fastening brackets are attached to the guide rails and adjusted to set a position of the fastening bracket along the guide rail and set the guide rail to shaft side wall structure spacing based on information measured before installation of the guide rail takes place in the shaft so that the guide rails provided with the fastening brackets can be lifted in the shaft and attached to the fastening points in a wall of the shaft without further adjustment of the fastening brackets.

13. The arrangement according to claim 12, whereby the fastening brackets comprises two bracket parts adjustable to each other, a first bracket part being attachable to the guide rail and a second bracket part being attachable to a wall in the shaft, whereby the first bracket part is attached into the correct height position of the guide rail after which the two bracket parts are adjusted to each other based on the information achieved in the measurement phase.

14. The arrangement according to claim 12, whereby a lowermost section of guide rail elements is manually installed to respective walls in the shaft, a transport apparatus is arranged to be movable upwards and downwards with a second hoist into the shaft in order to lift guide rail elements in the shaft, the transport apparatus comprising a hook device connected to the second hoist and a lever device connected to the hook device, a guide rail element is connected to the transport apparatus so that an upper end of the guide rail element is connected to the hook device and a lower end of the guide rail element is supported on the lever device, the transport apparatus and thereby also the guide rail element is moved upwards with the second hoist, the lever device gliding on the row of already installed guide rail elements, the guide rail element is connected to an upper end of the row of already installed guide rail elements, the fastening brackets of the guide rail element is attached to a wall of the shaft from the transport platform, the transport apparatus is moved downwards with the second hoist in order to fetch a new guide rail element, the lever device gliding on the row of already installed guide rail elements.

* * * * *